US008056523B2

(12) United States Patent
Ha et al.

(10) Patent No.: US 8,056,523 B2
(45) Date of Patent: Nov. 15, 2011

(54) ROCKER ARM APPARATUS FOR ENGINE CYLINDER DEACTIVATION

(75) Inventors: Kyoung Pyo Ha, Suwon-si (KR); Jin Kook Kong, Suwon-si (KR); Woo Tae Kim, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 450 days.

(21) Appl. No.: 11/940,524

(22) Filed: Nov. 15, 2007

(65) Prior Publication Data

US 2008/0141964 A1 Jun. 19, 2008

(30) Foreign Application Priority Data

Dec. 15, 2006 (KR) ..... 10-2006-0128693
Jul. 13, 2007 (KR) ..... 10-2007-0070363

(51) Int. Cl.
*F01L 1/18* (2006.01)

(52) U.S. Cl. ..... 123/90.39; 123/90.12; 123/90.44; 123/90.46; 74/559; 74/569

(58) Field of Classification Search ..... 123/90.39, 123/90.44, 90.12, 90.13, 90.46; 74/559, 74/567, 569
See application file for complete search history.

(56) References Cited

U.S. PATENT DOCUMENTS

| | | | |
|---|---|---|---|
| 4,768,467 | A | 9/1988 | Yamada et al. |
| 6,481,400 | B2 | 11/2002 | Hendriksma et al. |
| 6,655,331 | B2 | 12/2003 | Duesmann et al. |

FOREIGN PATENT DOCUMENTS

| | | |
|---|---|---|
| JP | 2001-329817 | 11/2001 |
| JP | 2005-180400 | 7/2005 |
| JP | 2006-090162 | 4/2006 |

*Primary Examiner* — Ching Chang
(74) *Attorney, Agent, or Firm* — Morgan, Lewis & Bockius LLP

(57) ABSTRACT

The present invention provides to a rocker arm apparatus for cylinder deactivation with a new structure for increasing fuel efficiency in a gasoline engine.

For this, the present invention provides a rocker arm apparatus for cylinder deactivation including: a rocker arm; a restoring spring supported at the bottom of a rear end portion of the rocker arm; a roller coupled to the rocker arm to be pressed by a cam; a pair of rocker shaft assemblies each including first and second rocker shafts, and a connecting rod integrally connecting the first and second rocker shafts; a pair of rocker shaft support members connected to the rocker arm by means of the first and second rocker shafts; and a transfer member for controlling the rocker shaft assembly.

5 Claims, 11 Drawing Sheets

ROCKER ARM APPARATUS FOR ENGINE CYLINDER DEACTIVATION

CROSS-REFERENCE TO RELATED APPLICATION

This application claims under 35 U.S.C. §119(a) on Korean Patent Application Nos. 10-2006-0128693, filed on Dec. 15, 2006, and 10-2007-0070363, filed on Jul. 13, 2007, the entire contents of which are incorporated herein by reference.

BACKGROUND OF THE INVENTION (a) Field of the Invention

The present invention relates to a rocker arm apparatus for engine cylinder deactivation. More particularly, the present invention relates to a rocker arm apparatus for engine cylinder deactivation with a new structure for increasing fuel efficiency in a gasoline engine.

(b) Background Art

In general, a cylinder deactivation system (CDS) is used to increase fuel efficiency in a gasoline engine.

The cylinder deactivation system is employed to save energy by deactivating some of engine cylinders, and it is necessary to close valves of the deactivated cylinders during the deactivation period in order to increase the effect of the cylinder deactivation.

In the cylinder deactivation system, all or a portion of the cylinders are deactivated, and existing methods for the cylinder deactivation are as follows:

1) In a conventional VTEC engine, the cylinder deactivation is effected by controlling a valve lift profile using connecting pins for connecting two cam profiles with two rocker arms and, and two rocker arms, respectively;

2) In an engine having a direct-acting valve train, the cylinder deactivation is effected using a dual-tappet; and 3) In a finger follower type cylinder deactivation system, a switching mechanism that can be moved by two cam profiles is provided in a finger follower.

In addition, although there are various types of cylinder deactivation systems, the present invention provides a new type of cylinder deactivation system of engine.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

The present invention has been made in an effort to provide a rocker arm apparatus for cylinder deactivation with a new structure for improving fuel efficiency in a gasoline engine, differently from existing cylinder deactivation systems that deactivate a portion of cylinders in a multi-cylinder engine.

In one aspect, the present invention provides a rocker arm apparatus for cylinder deactivation, including: a rocker arm; a restoring spring supported at the bottom of a rear end portion of the rocker arm; a roller coupled to the rocker arm to be pressed by a cam; a pair of rocker shaft assemblies each including first and second rocker shafts, and a connecting rod integrally connecting the first and second rocker shafts; a pair of rocker shaft support members connected to the rocker arm by means of the first and second rocker shafts; and a transfer member for controlling the rocker shaft assembly.

In a preferred embodiment, a connecting hole, into which the second rocker shaft is inserted, is formed penetrating through a rear end portion of the rocker arm in the longitudinal direction of the second rocker shaft, a pressing plate for pressing a valve is formed integrally at a front end portion of the rocker arm in the shape of a rectangular plate, and a roller mounting space for mounting the roller, penetrated upwards and downwards substantially at the middle portion of the rocker arm, is provided between the front and rear end portions of the rocker arm.

Preferably, the first rocker shaft protrudes longer from a position integrally formed with a front end portion of the connecting rode toward the rocker shaft support member, and the second rocker shaft protrudes longer from a position integrally formed with a rear end portion of the connecting rod toward the rocker arm.

Suitably, the rocker shaft support member includes a first assembly hole, into which the first rocker shaft is inserted, formed at a front end portion thereof in the longitudinal direction of the first rocker shaft, and a second assembly hole, into which the second rocker shaft is inserted, formed at a rear end portion thereof in the longitudinal direction of the second rocker shaft.

Moreover, an outer end portion of the second rocker shaft is formed having a short length with respect to the longitudinal axis of the connecting rod so as to be inserted into or disconnected from the first assembly hole, and an inner end portion of the second rocker shaft is formed having a long length with respect to the longitudinal axis of the connecting rod so as to keep inserted into the connecting hole of the rocker arm.

Furthermore, a first oil groove is further provided on the outer circumferential surface of the first rocker shaft, and a second oil groove is further provided on the outer circumferential surface of the inner end portion of the second rocker shaft.

In addition, an oil supply hole extending to the first assembly hole is further provided at a predetermined position of the rocker shaft support member, i.e., on the top where the first assembly hole is formed.

In another preferred embodiment, a first oil supply passage connected to the first oil groove is formed inside the first rocker shaft in the longitudinal direction thereof, a second oil supply passage connected to the first oil supply passage is formed inside the connecting rod in the longitudinal direction thereof, and a third oil supply passage connected to the second oil supply passage is formed in the inner end portion of the second rocker shaft in the longitudinal direction thereof.

Preferably, a projection is provided on both sides of the rocker arm such that the projection presses the connecting rod.

Suitably, the transfer member for controlling the first and second rocker shafts includes: at least a transfer plate provided on the outer side of the rocker shaft support member; at least a switching rod for reciprocating the transfer plate; a driving means connected to a rear end portion of the switching rod to angularly move the switching rod; at least a pair of transfer pressure rods formed integrally with the inner surface of the transfer plate and inserted into the first and second assembly holes of the rocker shaft support member; and a wedge member formed integrally with the outer surface of the transfer plate, with which a front end portion of the switching rod is in contact.

Moreover, the outer surface of the wedge member, with which the front end portion of the switching rod is in contact, is formed in an inclined surface.

Furthermore, a restoring spring for providing a restoring force to the transfer plate to move to home position after moving forward is inserted into the switching rod and thereby supported between the inner surface of the transfer plate and the outer surface of the rocker shaft support member.

In addition, a restoring spring is inserted and mounted in the connecting hole of the rocker arm with the inner end portion of the second rocker shaft disposed therebetween In another aspect, the present invention provides a rocker arm apparatus for cylinder deactivation, including: a rocker arm; a restoring spring supported at the bottom of a rear end portion of the rocker arm; a roller coupled to the rocker arm to be pressed by a cam; at least a rocker shaft support member disposed on both outer sides of the rocker arm; a pivot member engaged with the rocker shaft support member to give a pivot function to the rocker arm, or disengaged with the rocker shaft support member to make the rocker arm lose its pivot function; and a hydraulic pressure means for connecting or disconnecting the pivot member to or from the rocker shaft support member.

In a preferred embodiment, a connecting hole, through which the pivot member is inserted, is formed penetrating through a rear end portion of the rocker arm in the longitudinal direction of the pivot member, a pressing plate for pressing a valve is formed integrally at a front end portion of the rocker arm in the shape of a rectangular plate, and a roller mounting space for mounting the roller, penetrated upwards and downwards substantially at the middle portion of the rocker arm, is provided between the front and rear end portions of the rocker arm.

Preferably, the hydraulic pressure means includes: a hydraulic cylinder formed in the inside of a rear end portion of the rocker arm support member; a piston disposed in the hydraulic cylinder; a hydraulic pressure supply hole formed from the outer lateral surface of the rocker arm support member to the hydraulic cylinder for fluid communication; and a hydraulic pressure supply means for supplying or shutting off a hydraulic pressure to the hydraulic pressure supply hole.

Suitably, the pivot member includes: a spring compressibly disposed in the connecting hole formed in the rear end portion of the rocker arm; and at least a lock pin, positioned on both outer sides of the spring, of which both ends are inserted into both the hydraulic cylinder and the connecting hole during a normal operation of the rocker arm, or completely inserted into the connecting hole during a cylinder deactivation of the rocker arm.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like. The present systems will be particularly useful with a wide variety of motor vehicles.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
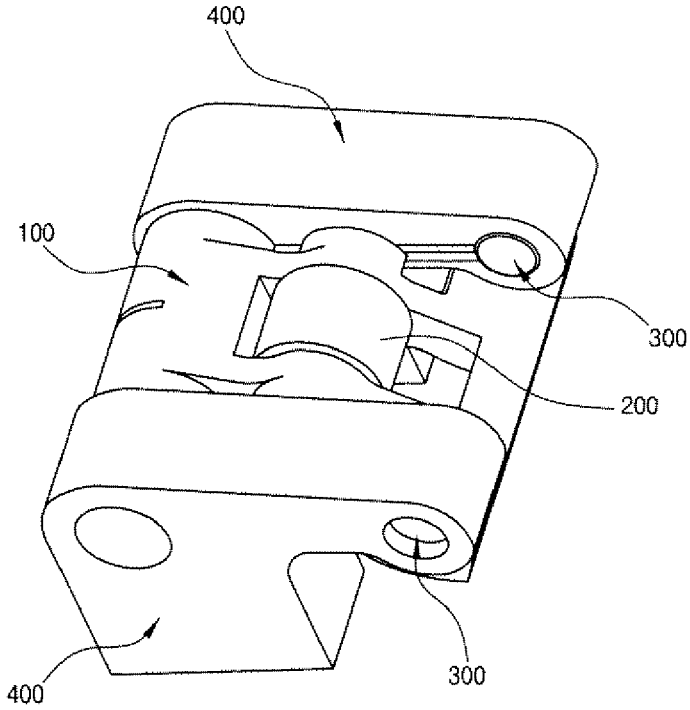
FIG. 1 is an assembled perspective view illustrating a rocker arm apparatus for cylinder deactivation in accordance with a preferred embodiment of the present invention.

Reference numerals set forth in the Drawings includes reference to the following elements as further discussed below:

| | | | |
|---|---|---|---|
| 100: | rocker arm | 102: | connecting hole |
| 104: | pressing plate | 106: | roller mounting space |
| 108: | engaging hole | 110: | projection |
| 200: | roller | 300: | rocker shaft assembly |
| 302: | first rocker shaft | 304: | second rocker shaft |
| 306: | connecting rod | | |
| 308: | inner end portion of the second rocker shaft | | |
| 310: | outer end portion of the second rocker shaft | | |
| 312: | first oil supply passage | | |
| 314: | second oil supply passage | 316: | third oil supply passage |
| 318: | first oil groove | 320: | second oil groove |
| 400: | rocker shaft support member | 402: | first assembly hole |
| 404: | second assembly hole | 406: | connecting rod insertion groove |
| 408: | oil supply hole | 500: | cam |
| 600: | valve | 700, and 704: | restoring springs |
| 800: | transfer member | 802: | transfer plate |
| 804: | transfer pressure rod | 806: | wedge member |
| 810: | switching rod | 900: | hydraulic cylinder |
| 902: | piston | 904: | hydraulic pressure supply hole |
| 906: | hydraulic pressure supply means | | |
| 908: | spring | 910: | lock pin |

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Figure 2:
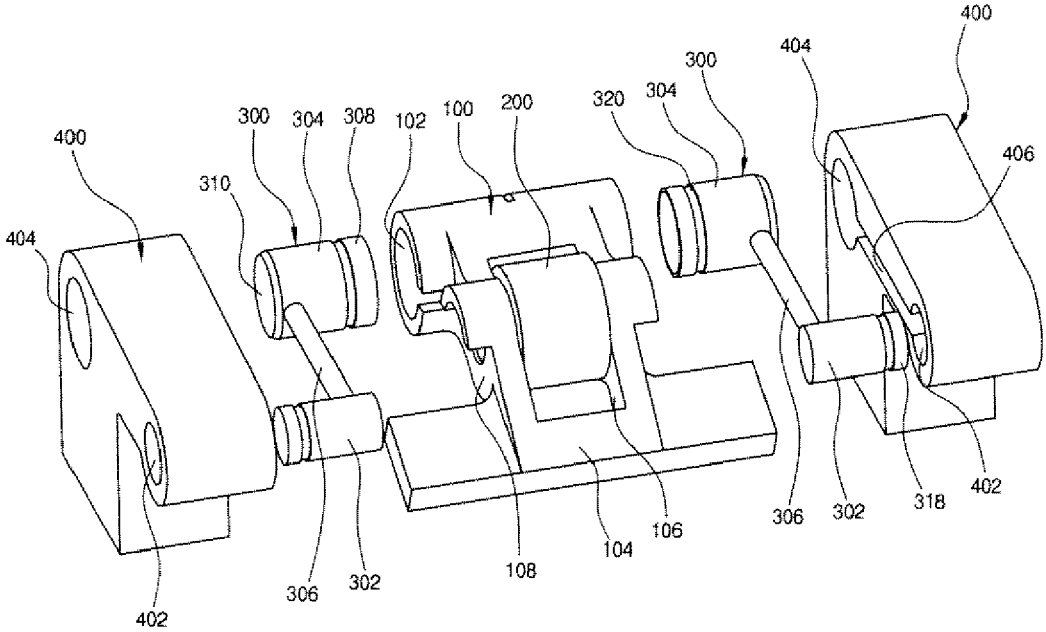
FIG. 2 is an exploded perspective view illustrating the rocker arm apparatus for cylinder deactivation in accordance with the preferred embodiment of the present invention.

FIG. 1 is an assembled perspective view illustrating a rocker arm apparatus for cylinder deactivation in accordance with a preferred embodiment of the present invention, and FIG. 2 is an exploded perspective view thereof.

A rocker arm apparatus for cylinder deactivation as an exemplary embodiment of the present invention broadly includes a rocker arm 100, a roller 200, a pair of rocker shaft assemblies 300 comprising a first rocker shaft 302, second rocker shaft 304 and a connecting rod 306, and a pair of rocker shaft support members 400.

A connecting hole 102 for coupling the rocker arm 200 with the rocker shaft support members 400 is formed penetrating through a rear end portion of the rocker arm 100 in the longitudinal direction of the second rocker shaft 304. A pressing plate 104 is formed integrally at a front end portion of the rocker arm 100 in the shape of a rectangular plate. A roller mounting space 106 for mounting the roller 200, penetrated upwards and downwards substantially at the middle portion of the rocker arm 100, is provided between the front and rear end portions of the rocker arm 100.

Moreover, an engaging hole 108, through which a rotational axis of the roller 200 inserted and coupled, is provided on both inner surfaces of the roller mounting space 106.

Accordingly, as the rotational axis of the roller 200 is coupled to the engaging hole 108 of the roller mounting space 106 of the rocker arm 100, the roller 200 is positioned rollable in the roller mounting space 106 with respect to the rotational axis of the roller 200.

The roller 200 may be disposed between the first rocker shaft 302 and the second rocker shaft 304 to give angular movement of the rocker arm 100 with respect to the first rocker shaft 302 and the second rocker shaft 304, depending on the cylinder deactivation or activation phase as explained below in detail.

The rocker arm 100 is coupled to the rocker shaft support members 400 by means of the rocker shaft assemblies 300.

The rocker shaft assembly 300, as commented above, includes first and second cylindrical rocker shafts 302 and 304 arranged in the front and rear thereof, and a connecting rod 306 connecting the two rocker shafts 302 and 304.

In particular, a front end portion of the connecting rod 306 is formed integrally with an inner end portion of the first rocker shaft 302, and a rear end portion of the connecting rod 306 is integrally formed substantially near to an outer end portion of the second rocker shaft 304.

Accordingly, the first rocker shaft 302 protrudes longer from a position integrally formed with the front end portion of the connecting rod 306 toward the rocker shaft support member 400, and the second rocker shaft 304 protrudes longer from a position integrally formed with the rear end portion of the connecting rod 306 toward the rocker arm 100.

The rocker shaft support members 400 are coupled to the rocker arm 100 by means of the locker shaft assemblies 300 and arranged on both outer sides of the rocker arm 100. The rocker shaft support member 400 includes first and second assembly holes 402 and 404 formed penetrating through the front end portion and the rear end portion thereof, respectively, in the longitudinal directions of the first and second rocker shafts 302 and 304, and a connecting rod insertion groove 406 formed between the two assembly holes 402 and 404 as shown in FIG. 2.

When assembling the rocker shaft assembly 300 with the rocker shaft support members 400, the first rocker shaft 302 is inserted and coupled to the first assembly hole 402, and an outer end portion 310 of the second rocker shaft 304, i.e., a portion having a shorter length than the first rocker shaft 302 with respect to the longitudinal axis of the connecting rod 306, is inserted and coupled to the second assembly hole 404 and then the connecting rod 306 is inserted and coupled to the connecting rod insertion groove 406.

Moreover, an inner end portion 308 of the second rocker shaft 304, i.e., a portion having a longer length than the outer end portion 310, is inserted and coupled to the connecting hole 102 of the rocker arm 100.

In this case, the rocker shaft assembly 300 moves in the longitudinal direction of the first and second cylindrical rocker shafts 302 and 304 within the rocker shaft support members 400.

In more detail, when the rocker shaft assembly 300 moves left and right, i.e., in the longitudinal direction of the first and second rocker shafts 302 and 304, the first rocker shaft 302 always stays in the first assembly hole 402 because at least a portion thereof is continuously inserted therein. However, the second rocker shaft 304 may be engaged or disengaged to the second assembly hole 404, depending on the operation of cylinder deactivation.

Also, the connecting rod 306 is coupled to the connecting rod insertion groove 406 or is disconnected therefrom, and a detailed description of an operation thereof will be given later.

Figure 3:
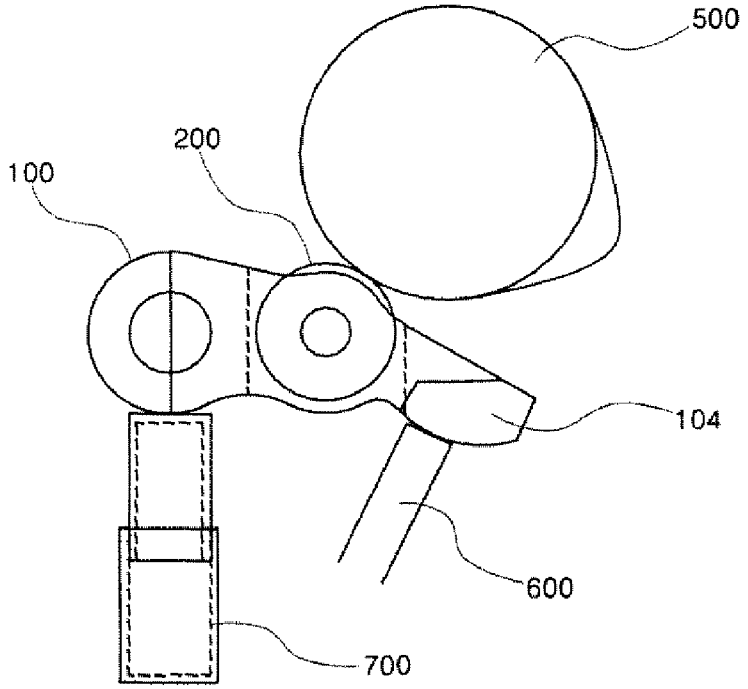
FIG. 3 is a side view illustrating a mounting position of the rocker arm apparatus for cylinder deactivation in accordance with the present invention.

FIG. 3 is a side view illustrating the rocker arm apparatus for cylinder deactivation in accordance with the present invention.

As shown in FIG. 3, a cam 500 is in rolling contact with the roller 200 coupled to the rocker arm 100, and thus a front end portion of the rocker arm 100, i.e., the pressing plate 104, presses a valve 600 with the operation of a cam 500, and a restoring spring 700 is disposed at the bottom of the rocker arm 100.

During normal operation, not during cylinder deactivation, the roller 200 is pressed by the rotation of the cam 500, and the rocker arm 100 angularly, i.e., clockwise in this example, moves with respect to the rotational axis of the second rocker shaft 304 such that the pressing plate 104 presses the valve 600.

On the other hand, during cylinder deactivation, that is, when the outer end portion 310 of the second rocker shaft 304 is disengaged from the second assembly hole 404, the roller 200 is pressed by the rotation of the cam 500 and thereby the rocker arm 100 rotates counterclockwise in this example, with respect to the rotational axis of the first rocker shaft 302 because the rotation of second rocker shaft 304 is not restricted anymore by the rocker shaft support member 400. As a result, the valve 600 is not pressed, but instead the restoring spring 700 positioned at the bottom of the rear end portion of the rocker arm 100 is pressed.

That is, since the first rocker shaft 302 serves as a pivot while the cam 500 presses the roller 200, the valve 600 is not pressed when the rocker arm 100 rotates with respect to the rotational axis of the first rocker shaft 302.

In this case, the force required to restore the rocker arm 100 pressed by the cam 500 is applied from the restoring spring 700 and, since the cylinder deactivation region corresponds to a region where the engine speed is low, the restoring spring 700 has an elastic restoring force weaker than that of a spring that the valve 600 has.

Figure 4A:
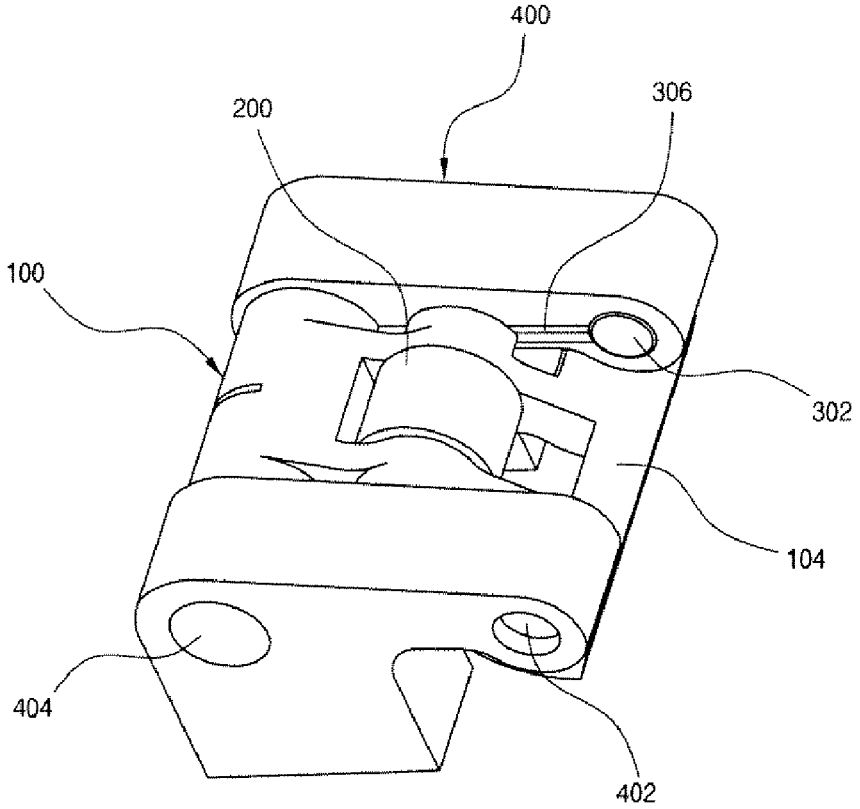
FIGS. 4A to 4C are diagrams illustrating operation states of the rocker arm apparatus for cylinder deactivation in accordance with the present invention during normal operation.
Figure 4B:
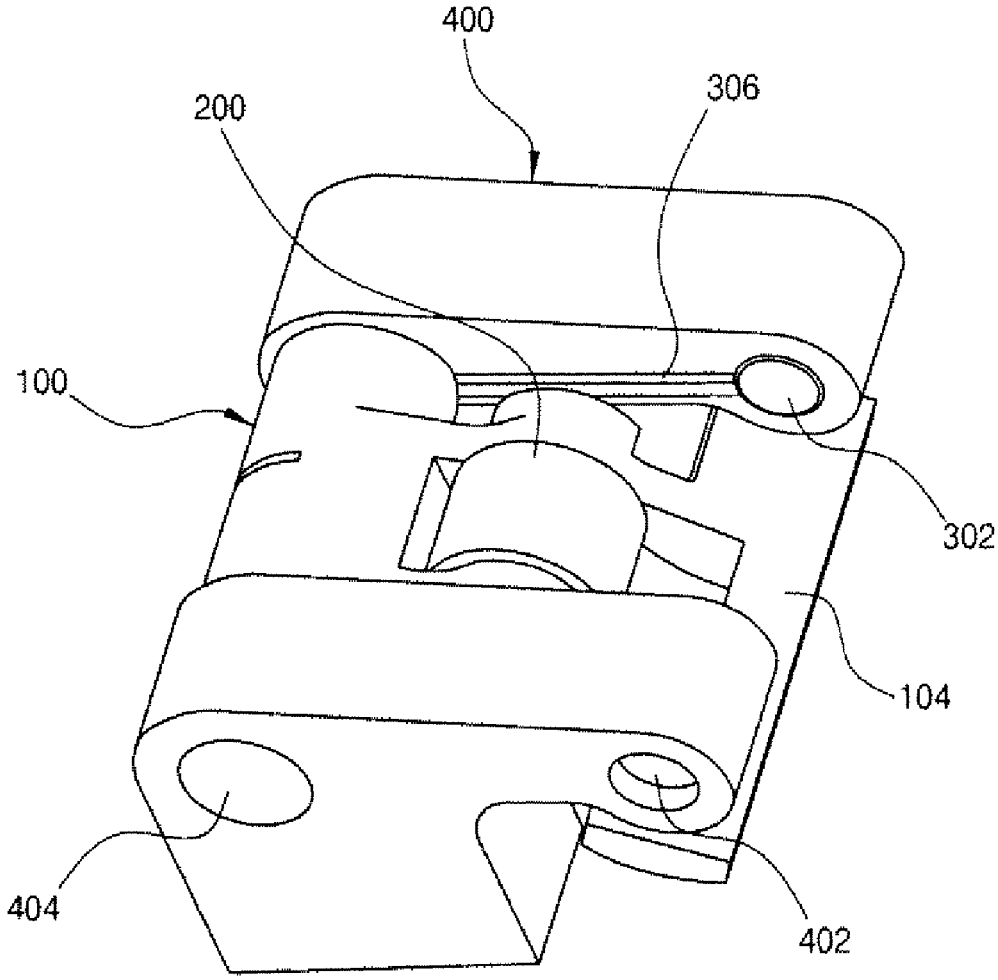
Figure 4C:
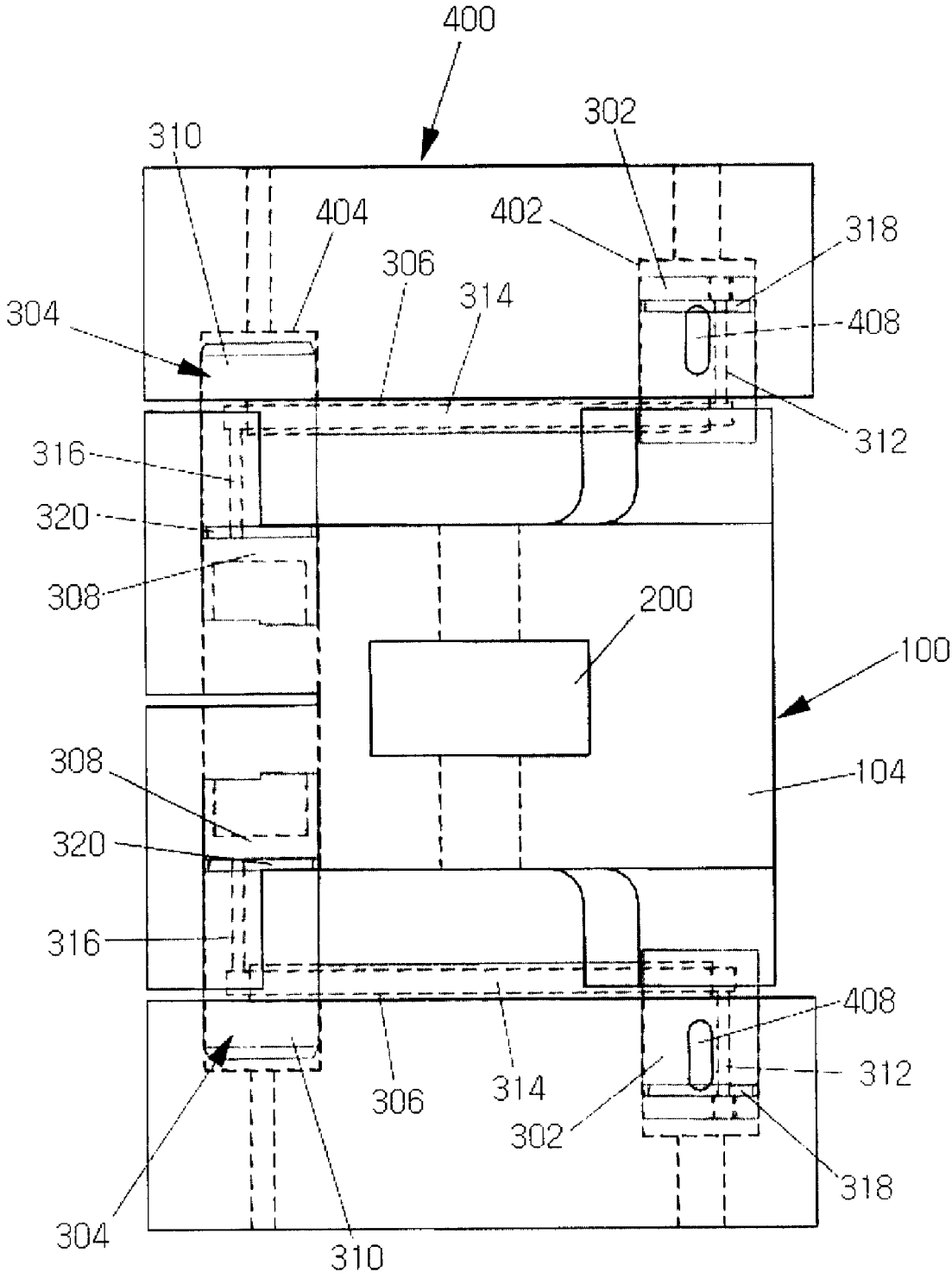

Next, the operation of the rocker arm during the normal operation, not during the cylinder deactivation, will be described in more detail with reference to FIGS. 4A to 4C FIGS. 4A to 4C are diagrams illustrating an operation state of the rocker arm apparatus for cylinder deactivation in accordance with the present invention during the normal operation.

As described above, during the normal operation, the rocker arm 100 angularly moves with respect to the rotational axis of the second rocker shaft 304, i.e., clockwise in this example. Moreover, as shown in FIG. 4, since the second rocker shaft 304 is inserted into both the connecting hole 102 of the rocker arm 100 and the second assembly hole 404 of the rocker shaft support member 400, the rocker arm 100 angularly moves with respect to the rotational axis of the second rocker shaft 304 because the second rocker shaft 304 serves as a pivot.

Accordingly, during the normal operation, not during the cylinder deactivation, as shown in FIG. 4A showing a state where the valve 600 is not pressed, and, as shown in FIG. 4B showing a state where the valve 600 is being pressed, when the roller 200 is pressed by the rotation of the cam 500, the rocker arm 100 angularly moves with respect to the rotational axis of the second rocker shaft 304 and thereby the pressing plate 104 of the rocker arm 100 moves downward to press the valve 600.

Meanwhile, a first oil groove 318 is provided on the outer circumferential surface of the first rocker shaft 302, and a second oil groove 320 is provided on the outer circumferential surface of the inner end portion 308 of the second rocker shaft 304.

Moreover, the first oil groove 318 and the second oil groove 320 are connected to each other by first to third oil supply passages 312, 314 and 316 for fluid communication. The first oil supply passage 312 connected to the first oil groove 318 is formed inside the first rocker shaft 302 in the longitudinal direction thereof, the second oil supply passage 314 connected to the first oil supply passage 312 is formed inside the connecting rod 306 in the longitudinal direction thereof, and the third oil supply passage 316 connected to the second oil supply passage 314 is formed in the inner end portion 308 of the second rocker shaft 304 in the longitudinal direction thereof.

Accordingly, the first oil groove 318 of the first rocker shaft 302 is connected to the second oil groove 320 of the second rocker shaft 304 by the first to third oil supply passages 312, 314 and 316 for fluid communication.

In this case, an oil supply hole 408 extending to the first assembly hole 402 is provided at a predetermined position of the rocker shaft support member 400, i.e., on the top where the first assembly hole 402, through which the first rocker shaft 302 is inserted and coupled, is formed.

Accordingly, if oil is provided to the oil supply hole 408, the oil is supplied to the first oil groove 318 of the first rocker shaft 302, the first oil supply passage 312 of the first rocker shaft 302, the second oil supply passage 314 of the connecting rod 306, the third oil supply passage 316 of the second rocker shaft 304, and finally to the second oil groove 320 formed on the inner end portion 308 of the second rocker shaft 304, thus providing lubrication between the outer circumferential surface of the first rocker shaft 302 and the inner circumferential surface of the first assembly hole 402 of the rocker shaft support member 400 and, further facilitating lubrication between the outer circumferential surface of the second rocker shaft 304 and the inner circumferential surface of the connecting hole 102 of the rocker arm 100.

Here, the operation of the rocker arm during the cylinder deactivation will be described in more detail with reference to FIGS. 5A to 5C.

Figure 5A:
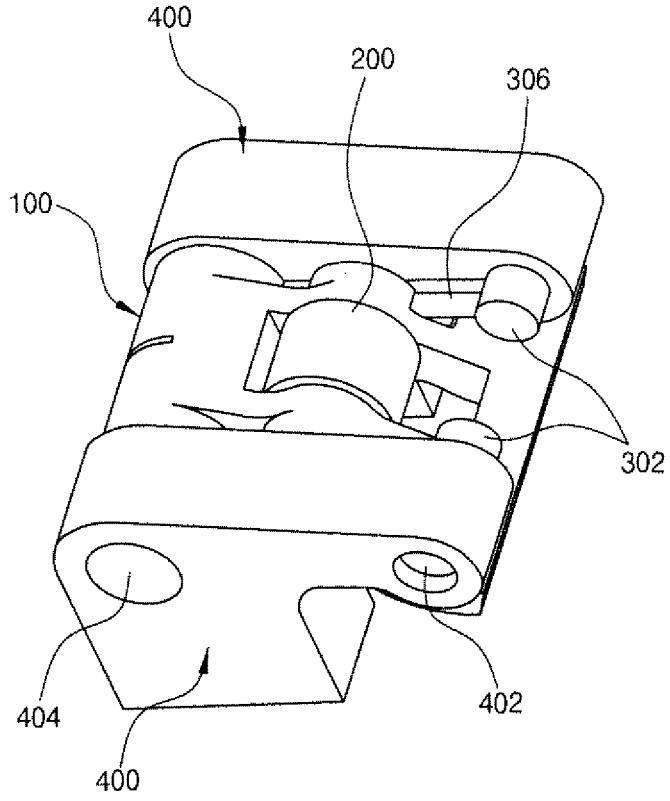
FIGS. 5A to 5C are diagrams illustrating operation states of the rocker arm apparatus for cylinder deactivation in accordance with the present invention during cylinder deactivation.
Figure 5B:
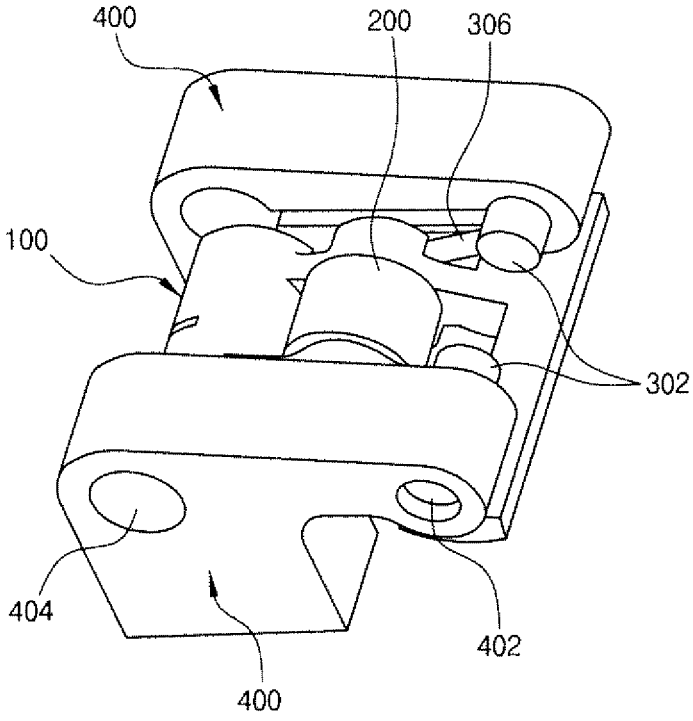
Figure 5C:
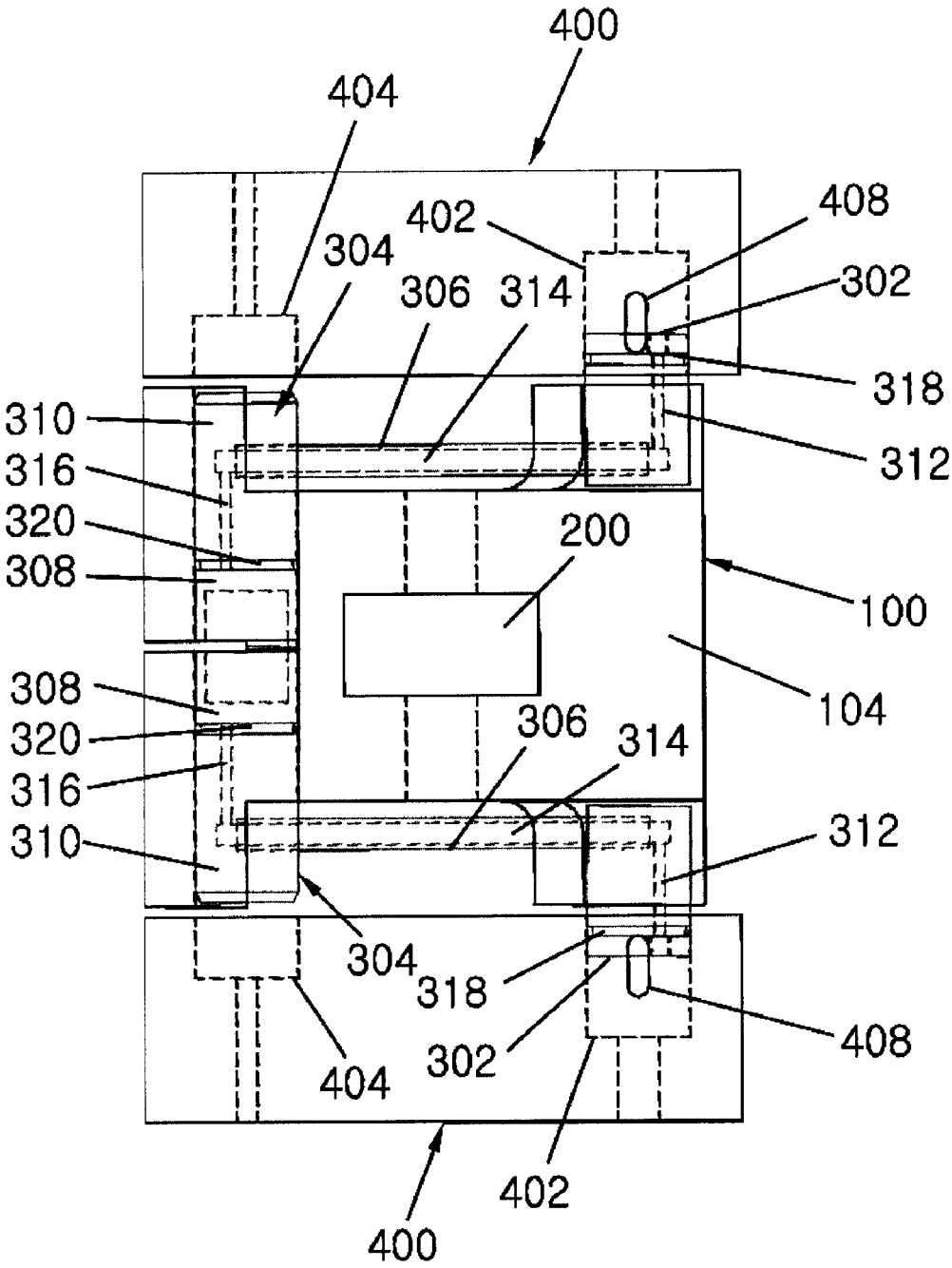

FIGS. 5A to 5C are diagrams illustrating an operation state of the rocker arm apparatus for cylinder deactivation in accordance with the present invention during cylinder deactivation, in which FIG. 5A shows a state where the rocker arm is not operated and FIG. 5B shows a state where the rocker arm operates.

During the cylinder deactivation, the outer end portion 310 of the second rocker shaft 304 is being disengaged from the second assembly hole 404 of the rocker shaft support member 400, and only the inner end portion 308 of the second rocker shaft 304 is positioned in the connecting hole 102 of the rocker arm 100. As a result, the second rocker shaft 304 does not act as a rotation axis of the rocker arm 100 but the first rocker shaft 302 does.

Accordingly, the rocker arm 100 angularly, i.e., counterclockwise in this example, moves with respect to the first rocker shaft 302 inserted into the first assembly hole 402 of the rocker shaft support member 400.

As shown in FIG. 5B, if the roller 200 is pressed by the rotation of the cam 500 during the cylinder deactivation, the rear end portion of the rocker arm 100 moves downward such that the rocker arm 100 angularly i.e., counterclockwise moves with respect to the rotational axis of the first rocker shaft 302, i.e. As a result, the valve 600 positioned under the pressing plate 104 of the rocker arm 100 is not pressed, but instead the restoring spring 700 positioned at the bottom of the rear end portion of the rocker arm 100 is pressed.

Meanwhile, the oil supplied through the oil supply hole 408 is delivered to the first and second oil grooves 318 and 320 formed on the surface of the first and second rocker shafts 302 and 304, thus providing lubrication between the outer circumferential surface of the first rocker shaft 302 and the inner circumferential surface of the first assembly hole 402 of the rocker shaft support member 400 and, further facilitating lubrication between the outer circumferential surface of the second rocker shaft 304 and the inner circumferential surface of the connecting hole 102 of the rocker arm 100.

The rotation of the rocker arm 100 with respect to the rotational axis of the first rocker shaft 302 during the cylinder deactivation can be achieved by the following two embodiments.

Figure 6:
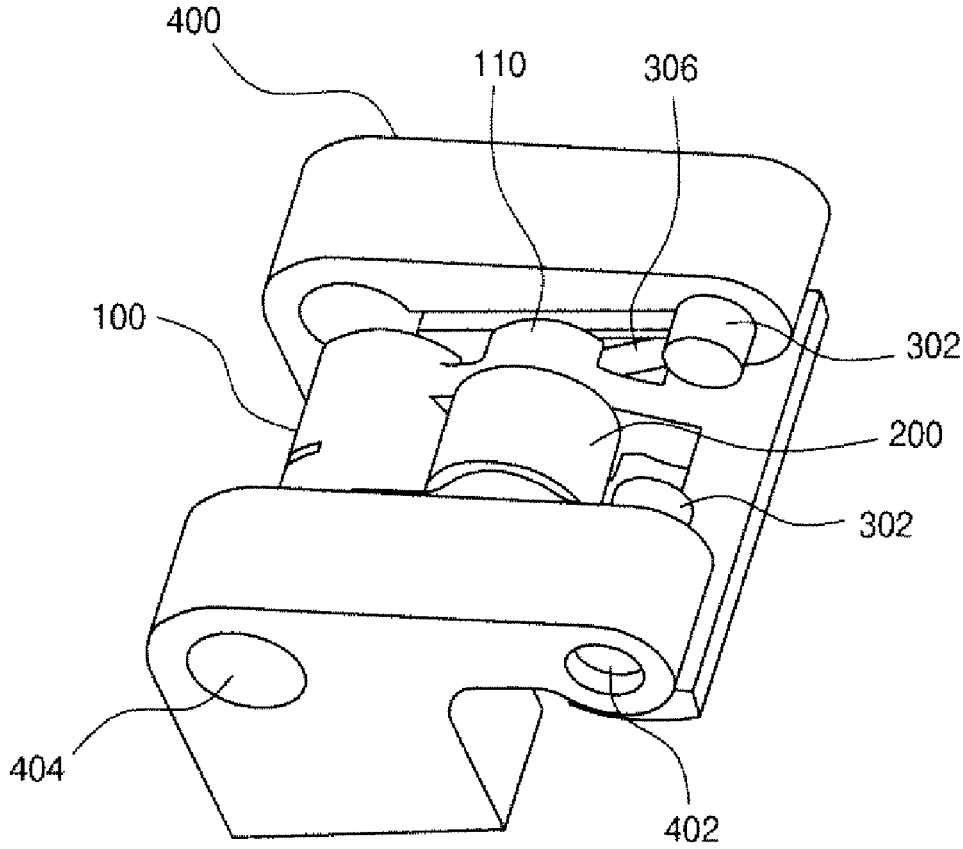
FIG. 6 is a diagram illustrating an operation state of the rocker arm apparatus for cylinder deactivation in accordance with the present invention, in which a rocker arm presses a rocker shaft during cylinder deactivation.

As the first embodiment, as shown in FIG. 6, a projection 110 is provided on both side ends of the rocker arm 100 such that the projection 110 presses the connecting rod 306.

In this case, if the roller 200 is pressed by the cam 500 and, at the same time, if the rocker arm 100 is pressed, the projection 110 of the rocker arm 100 presses the connecting rod 306 downwards and thereby the rear end portion of the rocker arm 100 moves downward such that the rocker arm 100 angularly moves with respect to the rotational axis of the first rocker shaft 302.

As the second embodiment, in a case where the projection 110 is not provided on both side ends of the rocker arm 100, when the roller 200 is pressed by the cam 500, the pressing plate 104 of the rocker arm 100 presses the top surface of the valve 600 and, at the same time, the rear end portion of the rocker arm 100 applies a force to the restoring spring 700. At this time, since the spring, not depicted, of the valve 600 for applying a restoring force has an elastic restoring force greater than that of the restoring spring 700, the rocker arm 100 angularly moves with respect to the rotational axis of first rocker shaft 302.

Next, an example in which the rocker shaft assembly 300 is controlled, that is, the outer end portion 310 of the second rocker shaft 304 is engaged to or disengaged from the second assembly hole 404 of the rocker shaft support member 400, will be described with reference to FIGS. 7A and 7B.

Figure 7A:
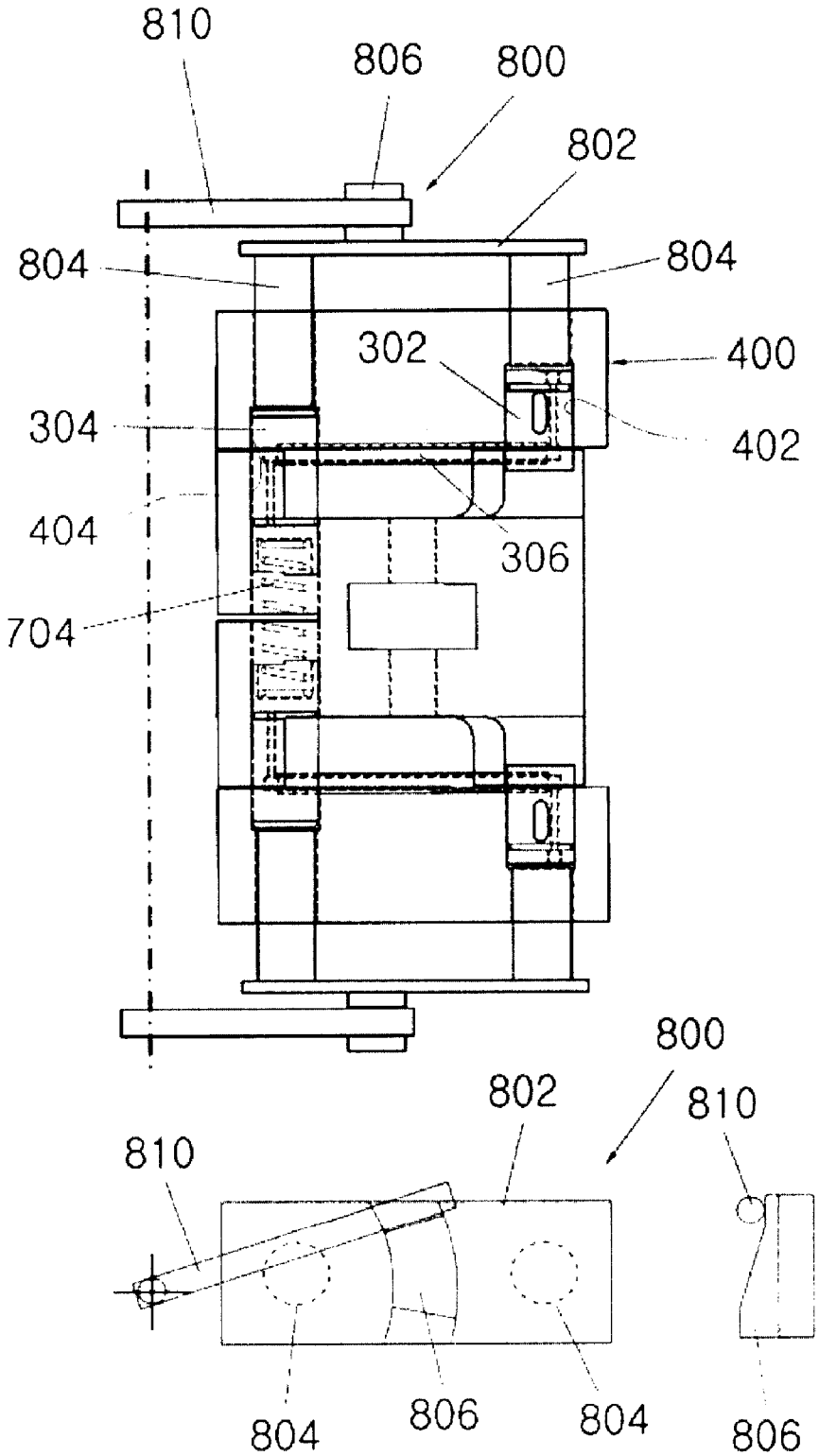
FIGS. 7A and 7B are diagrams illustrating means for controlling a rocker shaft assembly of the rocker arm apparatus for cylinder deactivation in accordance with the present invention.
Figure 7B:
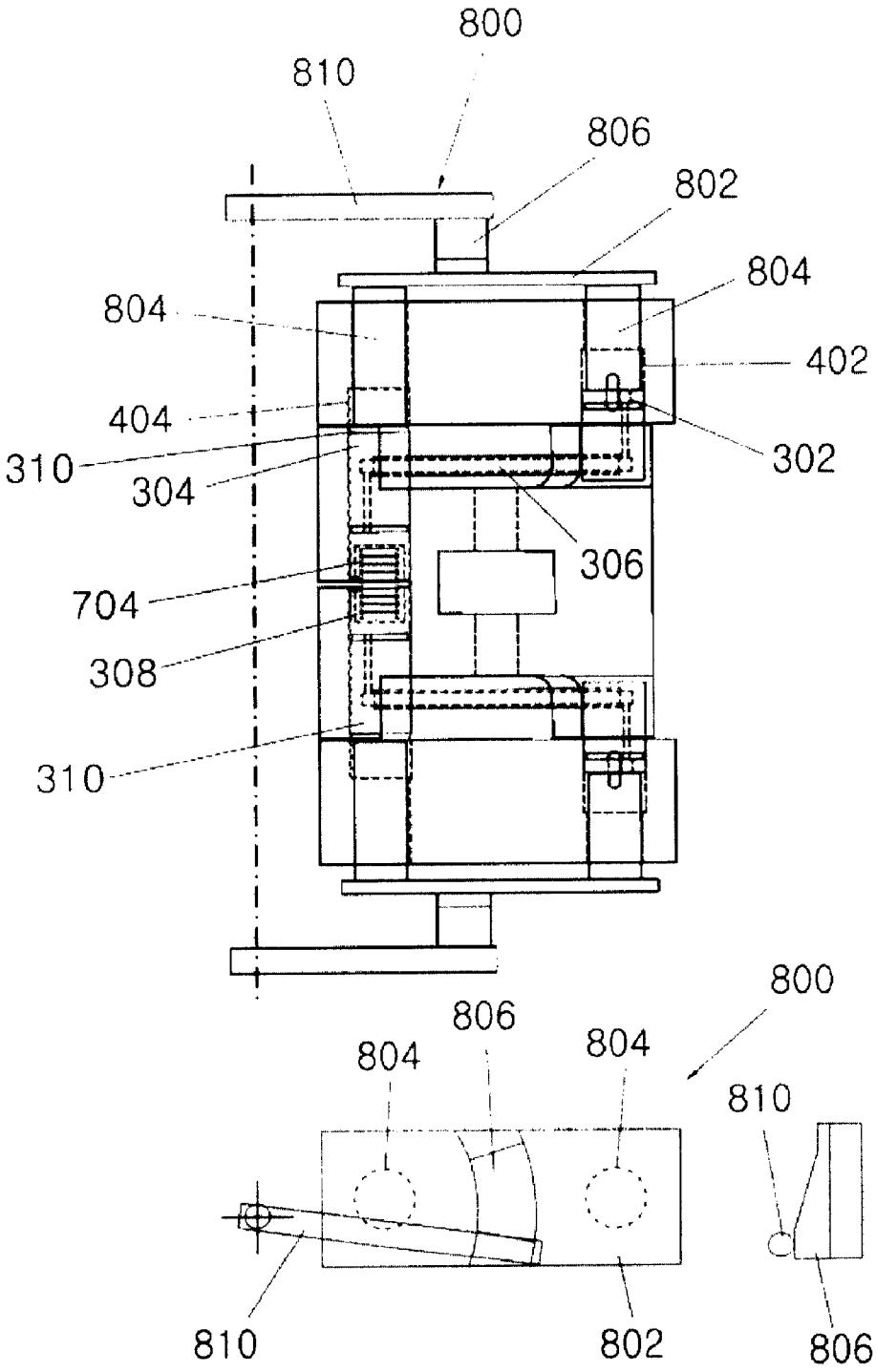

FIG. 7A is a diagram showing a state where the rocker shaft assembly 300 is not controlled, and FIG. 7B is a diagram showing a state where the rocker shaft assembly 300 has been controlled.

A transfer member 800 for controlling the rocker shaft assembly 300 includes a transfer plate 802, a switching rod 810 for controlling the transfer plate 802, and a driving means (not depicted), connected to a rear end portion of the switching rod 810 to angularly move the switching rod 810.

Especially, a pair of transfer pressure rods 804, inserted into the first and second assembly holes 402 and 404 of the rocker shaft support member 400, is formed integrally on the inner surface of the transfer plate 802.

Moreover, a wedge member 806, with which a front end portion of the switching rod 810 is in contact, is integrally formed on the outer surface of the transfer plate 802. The outer surface of the wedge member 806 is formed of an inclined surface.

As shown in FIG. 7A, if not during the cylinder deactivation, the front end portion of the switching rod 810 is being in contact with the lower flat bottom portion of the inclined surface of the wedge member 806.

However, in case of the cylinder deactivation as shown in FIG. 7B, the driving means angularly moves the switching rod 810 and, at the same time, the front end portion of the switching rod 810 moves along the inclined surface to the top portion of the wedge member 806 to pressurize the transfer plate 802 toward the rocker shaft support member 400.

Subsequently, the transfer plate 802 moves toward the rocker shaft support member 400 and, at the same time, the transfer pressure rods 804 attached to the transfer plate 802 push the first and second rocker shafts 302 and 304 to be inserted into the first and second assembly holes 402 and 404 of the rocker shaft support member 400 respectively.

Accordingly, since the first rocker shaft 302 is longer than the outer end portion 310 of the second rocker shaft 304, the first rocker shaft 302 keeps inserted into the first assembly hole 402 even if pushed, but the outer end portion 310 of the second rocker shaft 304 is disengaged from the second assembly hole 404 of the rocker shaft support member 400.

For the conversion of cylinder deactivation state to the cylinder activation state, a restoring spring 704 is mounted in the connecting hole 102 of the rocker arm 100 in order to reinsert the outer end portion 310 of the second rocker shaft 304 into the second assembly hole 404 of the rocker shaft support member 400 when the rocker arm 100 moves to the home position.

That is, as the inner end portion 308 of the second rocker shaft 304 is inserted into the connecting hole 102 of the rocker arm 100 against the restoring spring 704 disposed therebetween, the outer end portion 310 of the second rocker shaft 304 is disengaged from the second assembly hole 404 while the inner end portion 308 of the second rocker shaft 304 compresses the restoring spring 704.

In contrast, when the rear bottom surface of the rocker arm 100 is moved upward to the home position, rotating with respect to the first locker shaft 302 by the restoring force of the restoring spring 700 disposed therebelow, the outer end portion 310 of the second rocker shaft 304 is pushed by the restoring spring 704 in the connecting hole 102 to be reinserted into the second assembly hole 404 and, at the same time, the connecting rod 306 is inserted into the connecting rod insertion groove 406, thus being completely converted to the cylinder activation state.

Next, another preferred embodiment of the rocker shaft assembly of the present invention will be described in detail with reference to FIG. 8.

The present embodiment of the present invention has a feature in that it is possible to simplify the component parts and provide a cylinder deactivation function of the rocker arm using hydraulic pressure, compared with the above-described preferred embodiment of the present invention.

Figure 8:
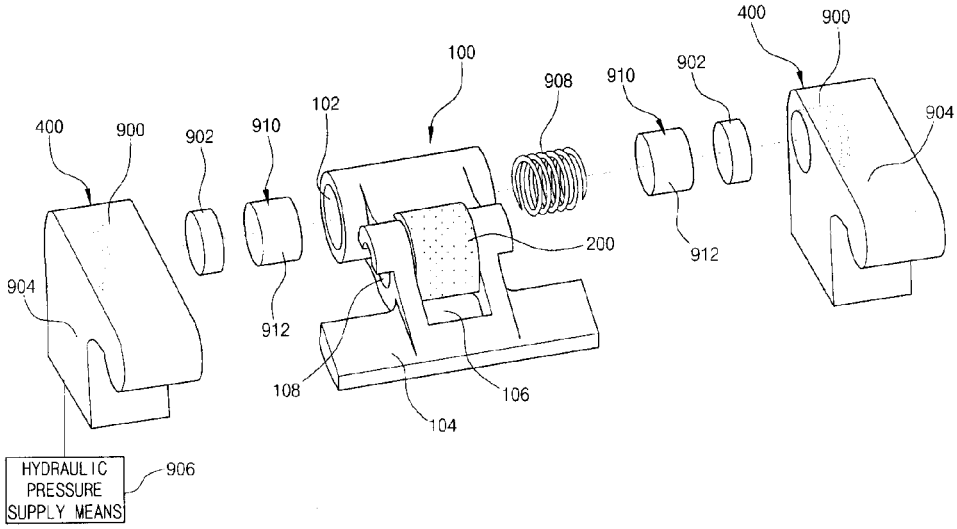
FIG. 8 is an exploded perspective view illustrating another embodiment of a locker shaft assembly in accordance with the present invention.

FIG. 8 is an exploded perspective view illustrating another embodiment of a locker shaft assembly in accordance with the present invention.

Like the above-described preferred embodiment, in this preferred embodiment of the locker shaft assembly, a connecting hole 102 for the engagement or disengagement of the end portion of the rocker arm 100 with a rocker shaft support member 400 is formed penetrating through a rear end portion of a rocker arm 100 in the longitudinal direction, a pressing plate 104 is formed integrally at a front end portion of the rocker arm 100 in the shape of a rectangular plate, and a roller mounting space 106 for mounting the roller 200, penetrated upwards and downwards substantially at the middle portion of the rocker arm 100, is provided between the front and rear end portions of the rocker arm 100.

Moreover, an engaging hole 108, through which a rotational axis of the roller 200 is inserted and coupled, is provided on both inner surfaces of the roller mounting space 106. Accordingly, as the rotational axis of the roller 200 is coupled to the engaging hole 108 of the rocker arm 100, the roller 200 is positioned to be rollable in the roller mounting space 106.

The rocker shaft support member 400, which serves as a supporting member for the rotation of the rocker arm 100, is positioned on both sides of the rocker arm 100. Preferably, the rocker shaft support member 400 may be mounted separately to a cylinder head, or the cylinder head itself may be processed to act as the rocker shaft support member 400.

Especially, a hydraulic cylinder 900 like the second assembly hole 404 is formed in the inside of the rear end portion of the rocker arm support member 400, and a piston 902 is disposed in the hydraulic cylinder 900.

Moreover, a hydraulic pressure supply hole 904 is formed from the outer lateral surface of the rocker arm support member 400 to the hydraulic cylinder 900 for fluid communication, and the hydraulic pressure supply hole 904 is connected to a hydraulic pressure supply means 906.

Accordingly, the hydraulic pressure provided from the hydraulic pressure supply means 906 is supplied through the hydraulic pressure supply hole 904 to the hydraulic cylinder 900, and thereby the piston 902 can be moved toward the rocker arm 100 by the hydraulic pressure. The piston 902 corresponds to the transfer pressure rod 804 of FIG. 7A.

Meanwhile, a spring 908 is compressibly disposed in the connecting hole 102 formed in the rear end portion of the rocker arm 100, and lock pins 910 are positioned on both sides of the spring 908 and serves as a pivot member as explained below. The lock pins 910 corresponds to the second rocker shaft 304 mentioned above During the normal operation of the rocker arm 100, the lock pins 910 are pushed outwardly from the connecting hole 102 by the restoring force of the spring 908 and thereby the outer end portions 912 of lock pins 910 are inserted into the hydraulic cylinder 900, i.e., the second assembly hole. On the other hand, during the cylinder deactivation of the rocker arm 100, the lock pin 910 is pushed inwardly by the piston 902 in the hydraulic cylinder 900 and, at the same time, inserted into the connecting hole 102 to compress the spring 908 against its restoring force and thus disengages the rocker arm 100 from the rocker shaft support members 400.

Next, the operation of the rocker shaft assembly in accordance with the embodiment of the present invention mentioned in FIG. 8 will be described in more detail with reference to FIGS. 9 and 10.

First, a normal operation state of the rocker arm will be described below.

Figure 9:
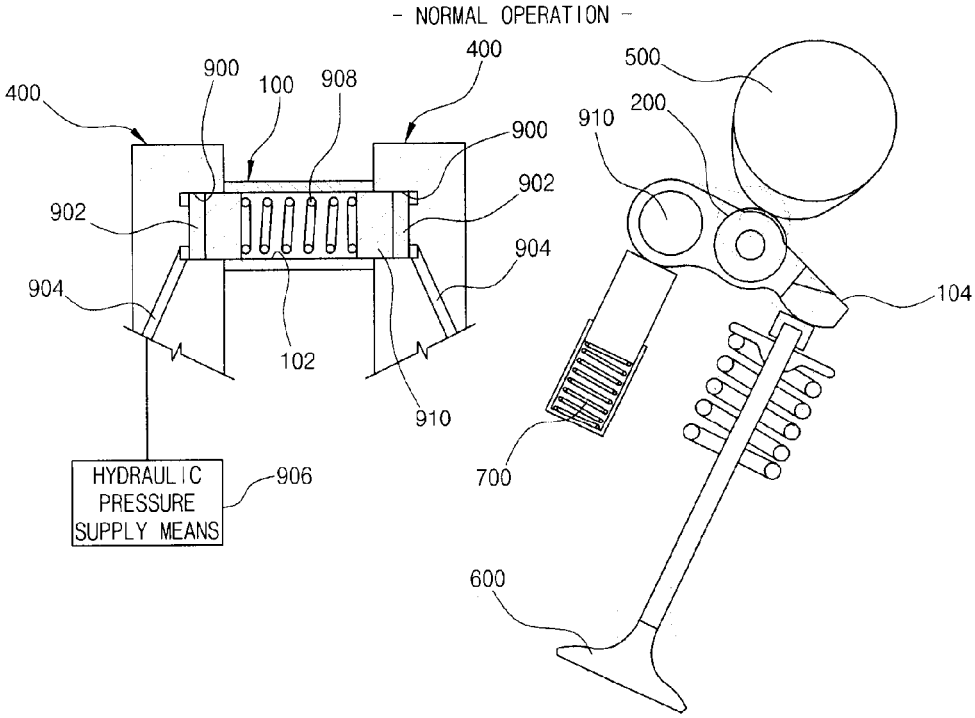
FIG. 9 is a cross-sectional view and a side view illustrating an operation state of the locker shaft assembly in accordance with the embodiment of FIG. 8, in which the rocker arm is normally operated.

FIG. 9 is a cross-sectional view and a side view illustrating an operation state of the second locker assembly in accordance with the embodiment of the present invention of FIG. 8, in which the rocker arm is normally operated.

In case of the normal operation of the rocker arm 100, in which the rocker arm 100 normally performs a valve lift function that lifts and lowers the valve 600, it becomes a hydraulic pressure release phase in which a hydraulic pressure supply by the hydraulic pressure supply means 906 is not supplied.

That is, the hydraulic pressure release phase is the phase in which a hydraulic pressure is not supplied from the hydraulic pressure supply hole 904 of the rocker arm support member 400 to the hydraulic cylinder 900. Accordingly, the outer end portion 912 of the lock pin 910 is pushed outward from the connecting hole 102 by the restoring force of the spring 908 and inserted into the hydraulic cylinder 900, and the piston 902 is pushed by the lock pin 910 to be positioned at the very end of the hydraulic cylinder 900. From this operation, the rocker arm 100 and the rocker shaft support member 400 keeps engaged.

Accordingly, referring to FIG. 9, as the roller 200 is pushed downwards by the rotation of the cam 500, the rocker arm 100 angularly, i.e., clockwise in this example, the rocker arm 100 moves around the lock pin 910 with respect to the rotation axis of the lock pin 910 which is inserted into the hydraulic cylinder 900. That is, the lock pin 910 serves as a pivot of the second rocker shaft 304 as shown in FIG. 2. As a result, the pressing plate 104 of the rocker arm 100 presses downwards the valve 600 such that the rocker arm 100 performs the valve lift function that is an intrinsic function of the rocker arm 100.

Lastly, the operation for the cylinder deactivation of the rocker arm will be described below.

Figure 10:
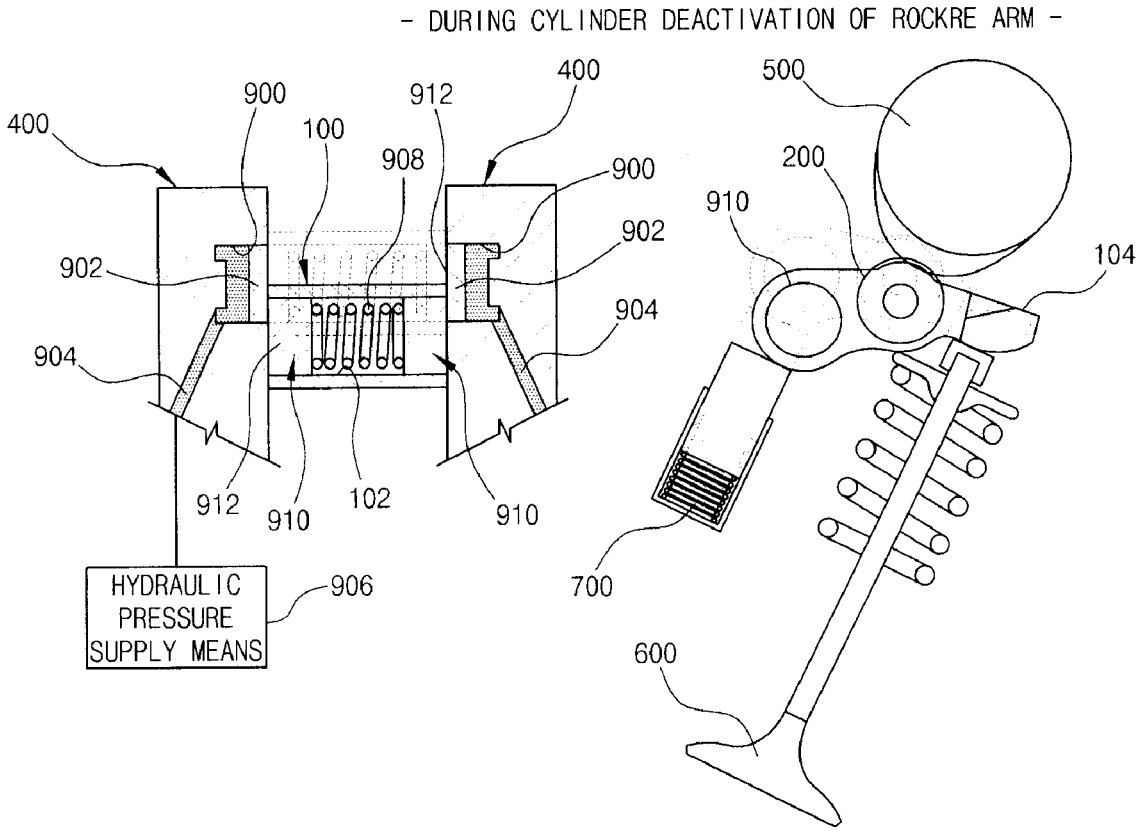
FIG. 10 is a cross-sectional view and a side view illustrating an operation state of the rocker shaft assembly in accordance with the embodiment of FIG. 8, in which the rocker arm is in a cylinder deactivation state.

FIG. 10 is a cross-sectional view and a side view illustrating an operation state of the second rocker assembly in accordance with the embodiment of the present invention of FIG. 8, in which the rocker arm is in a cylinder deactivation state.

In case of the operation for the cylinder deactivation of the rocker arm 100, in which the rocker arm 100 does not performs the valve lift function, it becomes a hydraulic pressure applying phase in which a hydraulic pressure supply by the hydraulic pressure supply means 906 is supplied.

That is, the hydraulic pressure applying phase is the phase in which a hydraulic pressure is supplied from the hydraulic pressure supply hole 904 of the rocker arm support member 400 to the hydraulic cylinder 900. At this time, the pistons 902 are moved toward the spring 908 positioned in the connection hole 102 by the hydraulic pressure to push the outer end portions 912 of the lock pins 910 and then the lock pins 910 are completely inserted into the connecting hole 102 to compress the spring 908 in the connecting hole 102. As a result, the lock pin 910 loses the pivot function thereof. From this operation, the rocker arm 100 and the rocker shaft support member 400 keeps disengaged.

Accordingly, as the roller 200 is pushed by the rotation of the cam 500, the rocker arm 100 losing the pivot function thereof cannot press the valve 600, but the rear end portion of the rocker arm 100 with the aid of connecting rod 306 as explained in FIG. 5B is moved downward, i.e., counterclockwise in this example, rotating with respect to the rotational axis of the first locker shaft 302. As a result, the restoring spring 700 positioned at the very end of the rocker arm 100 is pressed but the valve 600 is not pressed.

Meanwhile, in order for the rocker arm 100 to be returned from the cylinder deactivation to the normal operation, as the hydraulic pressure is released as described above, the rear end portion of the rocker arm 100 is moved upward by the restoring force of the restoring spring 700 and thereby the outer end portions 912 of the lock pins 910 are reinserted into the hydraulic cylinder 900 by the elastic restoring force of the spring 908 in the connecting hole 102, thus returning to the normal operation of the rocker arm 100.

As described above, the rocker arm apparatus for cylinder deactivation in accordance with the present invention provides the following effects:

1) It is possible to vary the engine valve lift into two steps;

2) It is possible to reduce the fuel injection amount by deactivating some of engine cylinders in an operation region where the engine load is low and to reduce pumping loss in deactivated cylinders, thus increasing fuel efficiency;

3) Since one cam profile is required to effect the cylinder deactivation, it is possible to reduce the processing cost of the engine;

4) As two valves are operated by one rocker arm apparatus, it is possible to reduce the number of the rocker arms, thus reducing the price of the engine, compared with existing methods; and 5) Since the valve lift switching mechanism is fixed, it is possible to use various type of switching mechanisms and it is easy to control the valve lift switching mechanism.

The forgoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiment were chosen and described in order to explain certain principles of the invention and their practical application, to thereby enable others skilled in the art to make and utilize various exemplary embodiments of the present invention, as well as various alternatives and modifications thereof. It is intended that technical spirit and scope of the present invention be defined by the Claims appended hereto and their equivalents.

What is claimed is:

1. A rocker arm apparatus for cylinder deactivation, comprising:

a cylinder valve including an upper valve end, wherein the cylinder valve is biased upwardly in an open position;

a rocker arm including opposing pivot ends aligned along a rear pivot axis located on a rear end portion of the rocker arm, the rocker arm further including a pressing plate having an arcuate bottom surface abutting against the upper valve end;

a restoring spring supporting the rear end portion of the rocker arm;

a roller coupled to the rocker arm to be pressed by a cam;

a pair of rocker shaft support members disposed adjacent to both opposing pivot ends of the rocker arm;

at least a pivot member selectively engaged with the rocker shaft support members to allow pivotal rotation of the rocker arm with respect to the rocker support shaft members; and hydraulic pressure means for engaging or disengaging the pivot member to or from the rocker shaft support members, wherein the arcuate bottom surface of the rocker arm rocks upon the upper valve end when the pivot member is disengaged from the rocker shaft support members.

2. The rocker arm apparatus of claim 1, wherein a connecting hole, through which the pivot member is inserted, is formed penetrating through the rear end portion of the rocker arm along the pivot axis, wherein the pressing plate is formed integrally at a front end portion of the rocker arm in the shape of a rectangular plate, and a roller mounting space for mounting the roller, extending upwards and downwards substantially at the middle portion of the rocker arm, is provided between the front and rear end portions of the rocker arm.

3. The rocker arm apparatus of claim 1, wherein the hydraulic pressure means comprises:

a hydraulic cylinder formed inside a rear end portion of the rocker arm support member;

a piston disposed in the hydraulic cylinder;

a hydraulic pressure supply hole formed from a lateral surface of the rocker arm support member to the hydraulic cylinder for fluid communication; and a hydraulic pressure supply means for supplying or shutting off a hydraulic pressure to the hydraulic pressure supply hole.

4. The rocker arm apparatus of claim 1 or 3, wherein the pivot member comprises:

a spring compressibly disposed in the connecting hole formed in the rear end portion of the rocker arm; and a pair of lock pins, positioned on opposing ends of the spring to interengage with both the hydraulic cylinder and the connecting hole during a normal operation of the rocker arm, or to be completely received within the connecting hole during a cylinder deactivation of the rocker arm.

5. A rocker arm apparatus for engine cylinder deactivation, comprising:

a cylinder valve including an upper valve end, wherein the cylinder valve is biased upwardly in an open position;

a rocker arm including a connecting hole and opposing pivot ends aligned along a rear pivot axis, the rocker arm further including a forward pressing plate, wherein the pressing plate includes a lower arcuate surface abutting against the valve end;

a restoring spring supporting the rocker arm adjacent the rear pivot axis;

a roller mounted on a middle portion of the rocker arm, wherein the roller is abuttingly engaged with a camshaft;

a pair of rocker shaft support members disposed adjacent the opposing pivot ends of the rocker arm for selectively pivotably supporting the rocker arm;

a pivot member mounted within the connecting hole of the rocker arm, wherein the pivot member is biased to extend from the opposing pivot ends to selectively engage the support members;

a hydraulic pressure means movable along the pivot axis when aligned with the pivot axis, the hydraulic pressure means configured to selectively engage and disengage the pivot member from the support members, wherein the rocker arm pivots about the pivot axis when the pivot member is engaged with the support members, and wherein the lower arcuate surface of the rocker arm rocks upon the valve end when the pivot member is disengaged from the support members.

* * * * *